US007458162B2

(12) United States Patent
Ossiansson et al.

(10) Patent No.: US 7,458,162 B2
(45) Date of Patent: Dec. 2, 2008

(54) DEVICE FOR A PORTABLE TOOL

(75) Inventors: Mattias Ossiansson, Huskvarna (SE); Peter Bjorkman, Nassjo (SE); Mikael Ganhammar, Huskvarna (SE); Erik Stegemyr, Bankeryd (SE)

(73) Assignee: Husqvarna AB, Huskvarna (SE)

( * ) Notice: Subject to any disclaimer, the term of this patent is extended or adjusted under 35 U.S.C. 154(b) by 113 days.

(21) Appl. No.: 10/524,908

(22) PCT Filed: Aug. 18, 2003

(86) PCT No.: PCT/SE03/01285

§ 371 (c)(1),
(2), (4) Date: Apr. 13, 2005

(87) PCT Pub. No.: WO2004/018170

PCT Pub. Date: Mar. 4, 2004

(65) Prior Publication Data

US 2005/0178346 A1 Aug. 18, 2005

(30) Foreign Application Priority Data

Aug. 21, 2002 (SE) ..... 0202495

(51) Int. Cl.
*B26B 7/00* (2006.01)

(52) U.S. Cl. ..... 30/276; 30/381; 123/195 R

(58) Field of Classification Search ..... 30/276, 30/381; 123/195 R
See application file for complete search history.

(56) References Cited

U.S. PATENT DOCUMENTS 4,610,229 A * 9/1986 Wissmann et al. ..... 123/195 R
5,029,393 A 7/1991 Nagashima et al.
5,243,764 A 9/1993 Wieland
6,363,618 B1 4/2002 Durr

* cited by examiner

*Primary Examiner*—Maurina Rachuba
(74) *Attorney, Agent, or Firm*—Pearne & Gordon LLP

(57) ABSTRACT

The claimed invention relates to an engine powered portable tool comprising a working tool placed on a working tool carrier clamped to a tool casing (10). In order to increase the strength in the section where the working tool carrier is clamped to the tool casing (10) is the working tool carrier clamped to a protruding part (20) of the crankcase (12) provided with a component (16) embedded in the crankcase (12) wall when the crankcase (12) is casted. The component (16) is made of a material with higher E-module than the material in the rest of the crankcase (12).

8 Claims, 2 Drawing Sheets

DEVICE FOR A PORTABLE TOOL

Figure 1:
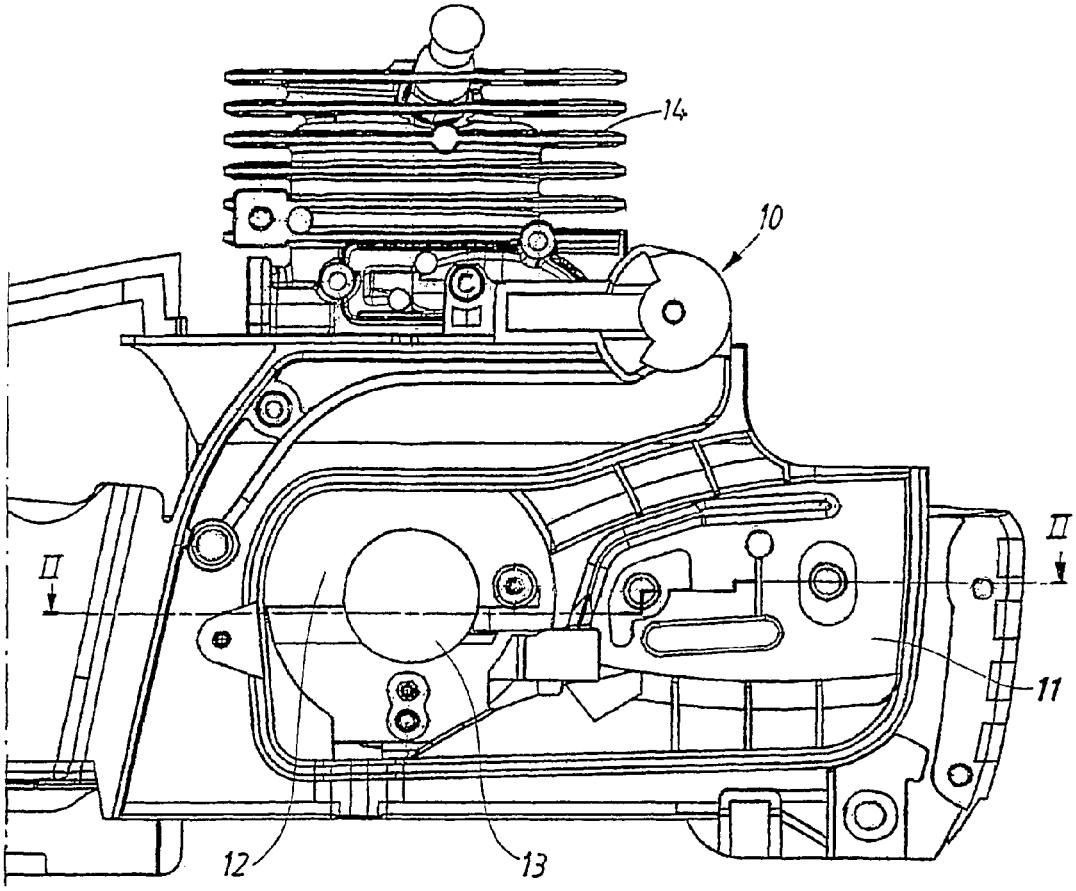

The invention relates to a new solution in order to increase the stiffness in the connection between the working tool carrier, where the working tool or tools are placed, and the body of a portable engine powered tool.

Portable handheld tools, like for example chain saws and power cutters, are used for different kinds of work in forestry and construction activities. The tools are available in several different embodiments adapted to meet the requirements of the work that it is supposed to do and also to meet the operators needs and physique.

The increased use of these types of tools makes it important that the tools are easy for the operator to handle and not subject the operator that is working long shifts with the tool to higher loads and risks than necessary.

The load that the operator is subjected to is a combination of the design of the tool and the actual weight of the tool. The weight of the tool is reduced either by an optimized design of the different components that are included in the tool or by making the components in materials with a low density. Both alternatives are normally used.

Many of the materials that is usable when it comes to efficient production, good shaping possibilities and low weight are, however, comparatively weak. This means that their E-module is low. Components made of these weak materials will consequently result in a weak tool, which will have a bad influence on the performance of the tool as well as increase the risk for breakdowns.

There are however materials with a low density, for example aluminum and magnesium, which have an E-module that is high enough to make the different components strong enough to handle the loads that they are subjected to. The cost for tools comprising components made of these materials is unfortunately very high since both the material and the manufacturing of components in these materials is more complicated because more advanced production methods are required.

One part of the tool that is subjected to high loads when the tool is used is the place where the working tool carrier is attached to the tool casing. This section is subjected to both bending and torsional moment when the tool is used. A high stiffness in this section is therefore required in order to ensure a high performance of the tool. There is a direct relationship between the stiffness in the section were the working tool carrier is attached to the tool casing and the final result of the performed work. Also the reliability and the safety for the operator are affected by the stiffness in this section.

The section were the working tool carrier is attached to the tool casing is a critical section on tools like chain saws and power cutters, especially on smaller and simpler models that have several components made of plastic materials in order to keep the prize and the weight of the tool at a low level.

In DE4134640C1 is a solution that increases the stiffness of the section where the guide bar is attached to the tool casing illustrated. The crankcase as well as the surface on the casing that the guide bar is aligning is made of a plastic material. In order to increase the stiffness in this section is one component made of a material with higher E-module than the plastic material in the crankcase. The component is placed so that one end of the component is in contact with the opposite side of the plastic surface that the guide bar is aligning on the casing while the other end of the component is secured in the crankcase. The guide bar is clamped to the casing by two bolts extending in perpendicular direction from the plastic surface on the casing that the guide bar aligns. The two bolts extend through the plastic detail and is secured in the component with higher E-module to increase the stiffness in the section were the guide bar is attached to the tool casing to improve the performance of the tool.

The solution described above, however, has several drawbacks. The guide bar aligns a surface made of a weak plastic material with a low E-module which means that there will be movement in the section were the guide bar is attached to the tool casing when the working tool carrier is subjected to high loads during use. The solution described in DE4134640C1 also includes several different components that will make the mounting of the tool time consuming and more complicated. Furthermore, the use of a separate component for increasing the stiffness in the section were the guide bar is attached to the tool casing takes a lot of space since the total height of the crankcase and the component is big.

In this application is a new solution for the section where the working tool carrier is attached to the tool casing illustrated. The new solution increases the stiffness in the section where the working tool carrier is attached to the tool casing and reduces the space that is needed. The new solution also keeps the cost for material and manufacturing at a reasonable level without increasing the total weight of the tool.

This new solution, which is further defined in the claims, for tools provided with a crankcase in a material with a low E-module, for example a plastic material, means that a reinforcement component is embedded in the crankcase at the same time as the crankcase is casted.

The reinforcement component could have different shapes but will always extend between the crankcase and the section where the working tool carrier is attached to the tool casing. In order to achieve maximum stiffness in the section is the embedded reinforcement placed so that it creates a part or the entire surface on the tool casing that the working tool carrier aligns. The surface of the embedded reinforcement component is not covered by the material that the rest of the crankcase is made of so that the reinforcement component is in direct contact with the surface of the working tool carrier. The reinforcement component is made of a material with an E-module higher than the material in the crankcase.

The new solution makes the working tool carrier align a surface with a high E-module, instead of like the solution described in DE4134640C1 where the guide bar is aligning a plastic surface with a low E-module which will cause bigger movements between the guide bar and the tool casing.

The working tool carrier is clamped to the surface on the tool casing by bolts. The working tool carrier is thereby fastened to the tool via the embedded reinforcement component. This solution increases the stiffness in the section where the working tool carrier is attached to the tool casing considerably since the intermediate layer of a material with low E-module is eliminated.

The new solution described above also reduces the numbers of components in the tool. The manufacturing and mounting process of the tool is thereby facilitated. The reduced number of components also reduces the total weight of the tool, which is favorable for this type of tools since the operator is carrying the tool and a lower weight reduces the loads on the operator.

The new solution with an embedded reinforcement in the weaker crankcase not only reduces the number of components and it also reduces the total size of the crankcase and related components. This means that it is possible to reduce the size of the tool, which makes it easier for the operator to handle and use the tool.

One embodiment of the claimed invention is illustrated in the drawings:

FIG. 1. Illustrates a side view of the tool casing for a chain saw.

Figure 2:
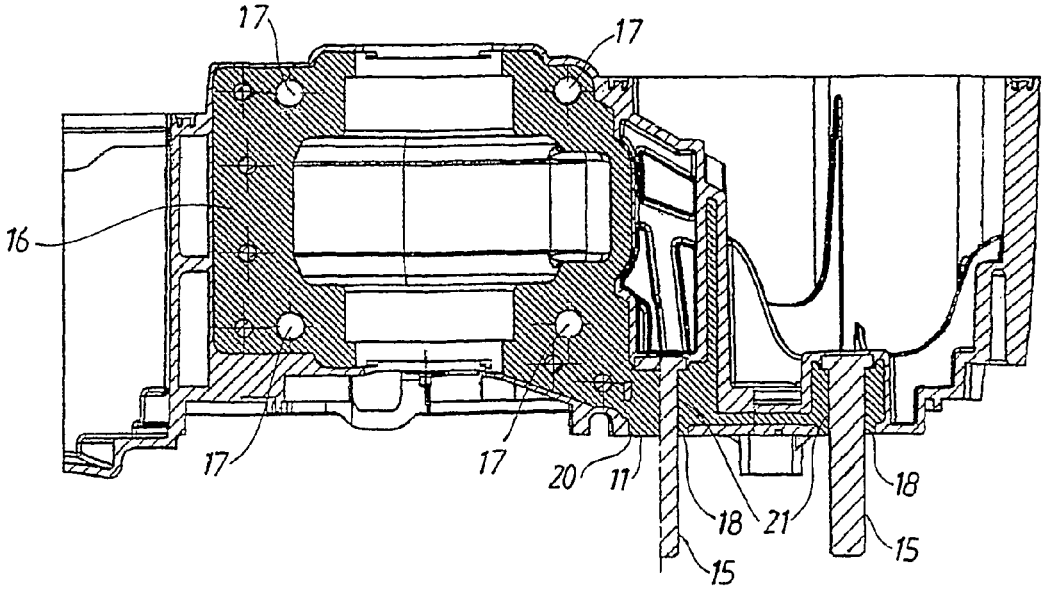

FIG. 2. Illustrates a cross section along line II-II through the tool casing in FIG. 1.

Figure 3:
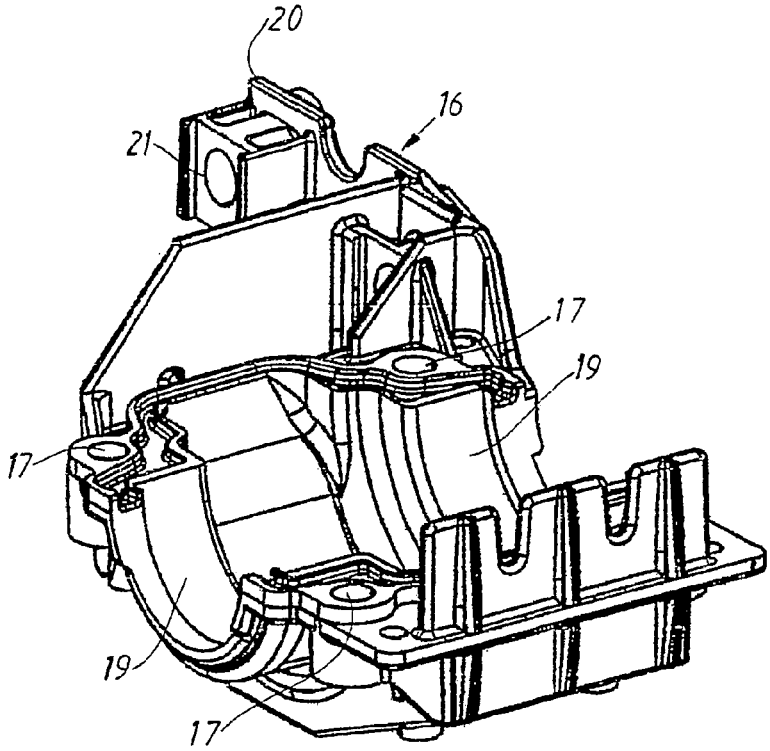

FIG. 3. Illustrates a perspective view of the reinforcement component before it is embedded in the crankcase.

Figure 4:
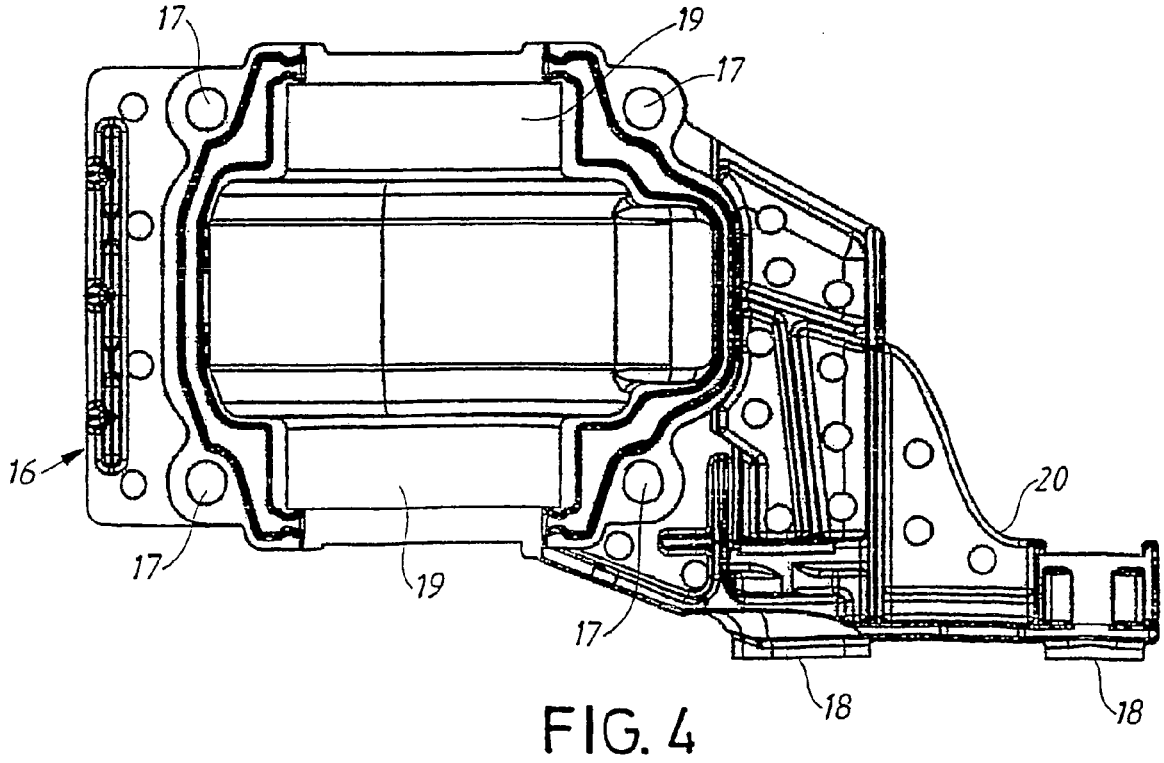

FIG. 4. Illustrates the reinforcement component seen from above.

In FIG. 1 is a tool casing 10 for a chain saw illustrated. The tool casing 10 includes a number of different parts like for example a surface 11 that a working tool carrier will be clamped to. If the tool is a chain saw, the working tool carrier will be a not illustrated guide bar. One side of the crankcase 12 is illustrated to the left of the surface 11. The crankcase 12 has an opening 13 for a not illustrated crankshaft that will drive the working tool extending from the working tool carrier. Above the crankcase 12 is a cylinder 14 for the combustion engine placed.

FIG. 2 illustrates a cross section through the tool casing 10 in FIG. 1. Two bolts 15 for clamping the working tool carrier to the tool casing 10 extend from the surface 11 that the working tool carrier aligns. In this cross section through the crankcase 12 is a component 16 used for reinforcing the section where the working tool carrier is attached to the tool casing 10. The component 16 is embedded in the crankcase 12 walls when the crankcase 12 is casted in a mould and placed so that it extends between the crankcase 12 and the surface 11 that the working tool carrier aligns. The shape of the component 16 makes it possible to fasten the bolts 15 for clamping the working tool carrier to the surface 11. The bolts are secured directly in the component 16 or with suitable nuts placed in recesses in the component 16.

The crankcase 12 normally comprises several different parts and the crankcase 12 is divided along a line through the centre of the not illustrated crankshaft to facilitate the manufacturing and mounting. The different parts of the crankcase 12 are held together by screws passing through the four holes 17 in the lower part of the crankcase 12 and the corresponding holes in the cylinder 14. The holes 17 for the screws also extend through the component 16 used for reinforcing the structure that are placed in one part of the crankcase 12 which will increase the stiffness in the crankcase 12, the surface 11 and the working tool carrier since the component 16 is held in the right position in relation to the different parts of the crankcase 12.

The crankcase 12 is made of a material with a lower E-module than the component 16. In order to increase the stiffness in the section where the working tool carrier is attached to the tool casing 10 further is the protruding part 20 of the component 16 that creates the surface 11 not covered by the material that that the rest of the crankcase 12 are made of so that a section 18 is generated. This makes the working tool carrier align the component 16 via the section 18 with higher E-module than the rest of the crankcase 12. This increases the stiffness.

In FIG. 3 is a perspective view of the component 16 used for reinforcing the section where the working tool carrier is attached to the tool casing. The component 16 is shaped to fit into the lower part of the crankcase 12. This means that the component for example is provided with recesses 19 for bearings for the not illustrated crankshaft. Selected parts of the component 16 are not embedded by the material with lower E-module during the casting of the crankcase 12 since this will improve the result of the crankcase 12 when it is finally put together. The screws that keep the different parts of the crankcase 12 together extend through holes 17 in the component 16 to secure the component 16 in relation to the different parts of the crankcase 12. The protruding part 20 of the component 16 is provided with two recesses 21 where the two bolts 15 for clamping the working tool carrier to the tool casing is fastened and the section 18 that the working tool carrier aligns.

FIG. 4 illustrates the component 16 seen from above. In this figure is the component 16, opposite the other figures, separated from the rest of the tool casing. The protruding part 20 and the section 18 that aligns the working tool carrier is here clearly illustrated.

The invention claimed is:

1. Engine powered portable tool comprising a working tool placed on a working tool carrier clamped to a tool casing (10) comprising at least a crankcase (12) characterized in that the working tool carrier is clamped to abut a non-embedded section (18) of a component (16) embedded in the crankcase (12) wall when the crankcase (12) is casted, said component (16) is made of a material with higher E-module than the material in the rest of the crankcase (12).

2. Engine powered portable tool according to claim 1, characterized in that the component (16) is shaped so that it is a part of the crankcase (12) and extend between the crankcase (12) and the section where the working tool carrier is clamped to the tool casing (10).

3. Engine powered portable tool according to claim 1, characterized in that the component (16) is made of aluminum, magnesium or some type of metal composition.

4. Engine powered portable tool according to claim 1, characterized in that the crankcase (12) is made of a plastic material or a material with low density.

5. Engine powered portable tool according to claim 1, characterized in that a protruding part (20) of the component (16) is provided with a surface (11) that the work tool carrier is clamped to.

6. Engine powered portable tool according to claim 5, characterized in that the section (18) is a part of or the entire surface (11) that the working tool carrier aligns.

7. Engine powered portable tool according to claim 5, characterized in that the working tool carrier is clamped to the tool casing (10) by one or more bolts (15) secured in the component (16) or thereto and by related nuts.

8. Engine powered portable tool according to claim 1, characterized in that the component (16) is placed in such a way in the crankcase (12) that at least one of the screws that keep the different parts of the crankcase (12) together also extend through the component (16).

* * * * *